US005317295A

United States Patent [19]

Ferullo et al.

[11] Patent Number: 5,317,295

[45] Date of Patent: May 31, 1994

[54] MOLDED CASE CIRCUIT BREAKER TRIP-TO-TEST BUTTON

[75] Inventors: David A. Ferullo, Bristol; Roger J. Morgan, Simsbury; James L. Rosen, West Hartford, all of Conn.

[73] Assignee: General Electric Company, New York, N.Y.

[21] Appl. No.: 28,202

[22] Filed: Mar. 8, 1993

[51] Int. Cl.[5] ..... H01H 9/00

[52] U.S. Cl. ..... 335/172; 335/165

[58] Field of Search ..... 335/165-176, 335/21, 22, 44, 45

[56] References Cited

U.S. PATENT DOCUMENTS

| | | | |
|---|---|---|---|
| 3,671,890 | 6/1972 | Klein et al. | 335/22 |
| 4,591,942 | 5/1986 | Willard et al. | 361/97 |
| 4,728,914 | 3/1988 | Morris et al. | 336/6 |
| 4,754,247 | 6/1988 | Raymont et al. | 335/202 |
| 4,864,263 | 9/1989 | Castonguay et al. | 335/167 |
| 4,982,173 | 1/1991 | Meiners et al. | 335/21 |
| 5,027,092 | 6/1991 | Castonguay et al. | 335/172 |
| 5,075,658 | 12/1991 | Lesslie et al. | 335/14 |

*Primary Examiner*—Lincoln Donovan

*Attorney, Agent, or Firm*—Richard A. Menelly

[57] ABSTRACT

An electronic trip molded case circuit breaker includes components that are designed for high speed robotic assembly. A unitary trip-to-test button is down-loaded within the circuit breaker housing for automatic alignment with the circuit breaker operating mechanism during the circuit breaker assembly process. The trip-to-test button includes an exhaust gas barrier along with a roller actuator for interacting with the circuit breaker operating mechanism during a test function.

9 Claims, 5 Drawing Sheets

MOLDED CASE CIRCUIT BREAKER TRIP-TO-TEST BUTTON

BACKGROUND OF THE INVENTION

Industrial-rated circuit breakers are currently available having operating components that are designed for automatic assembly to provide cost improvement as well as improved operating efficiency. The precision alignment performed by the automated assembly equipment assembles the operating components within very close operating tolerances. An operating mechanism designed for down-loaded automated assembly is described in U.S. Pat. No. 4,864,263. The operating mechanism assembly includes a pair of operating springs that are overcentered for rapidly driving the movable contact arm and the attached movable contact away from the stationary fixed contact to interrupt the circuit current. The operating mechanism includes a cradle operator which engages a latch assembly to prevent the movable contact arm from being driven to its open position under the urgence of the charged operating springs. The compact latch assembly includes a primary and secondary latch operating within a common support structure.

U.S. Pat. No. 3,671,890 entitled "Manually Operable Molded Case Circuit Breaker With Special Trip Testing Means" and U.S. Pat. No. 4,982,173 entitled "Rotatable Trip Test Assembly for Molded Case Circuit Breakers" both describe a trip-to-test button that allows the circuit breaker operating mechanism to be manually articulated for test purposes. In some applications, it is more advantageous to articulate the operating mechanism by linear displacement of the trip-to-test button shaft rather than by rotation.

U.S. Pat. No. 5,075,658 entitled "Molded Case Circuit Breaker Trip-To-Test Button and Auxiliary Switch Interface" describes one such trip-to-test button having an extended shaft for interacting with the circuit breaker operating mechanism that is automatically assembled during the circuit breaker manufacturing process.

When such trip-to-test buttons are used within higher ampere rated applications in accordance with European Electrical Industry Standards, the arc gases generated within the circuit breaker enclosure when such breakers are tested under full load conditions contact the bottom parts of the trip-to-test buttons that interact with the circuit breaker operating mechanism. The accumulation of the associated debris that accompanies the arc gases could interfere with future trip-to-test functions.

One purpose of the invention, accordingly, is to provide a trip-to-test button assembly that is automatically assembled and integrally protected against arc gas debris contamination.

SUMMARY OF THE INVENTION

The invention comprises a two piece trip-to-test button for industrial circuit breakers. One piece defines a top part extending outside the circuit breaker enclosure for external access. The other piece is in the form of a spring-loaded sleeve assembly open at the top and including a pivotally-mounted roller at the bottom. A bottom extension on the top piece snappingly engages with the bottom piece causing both top and bottom pieces to move in unison when the top piece is depressed to articulate the circuit breaker operating mechanism.

DESCRIPTION OF THE PREFERRED EMBODIMENT

Figure 1:
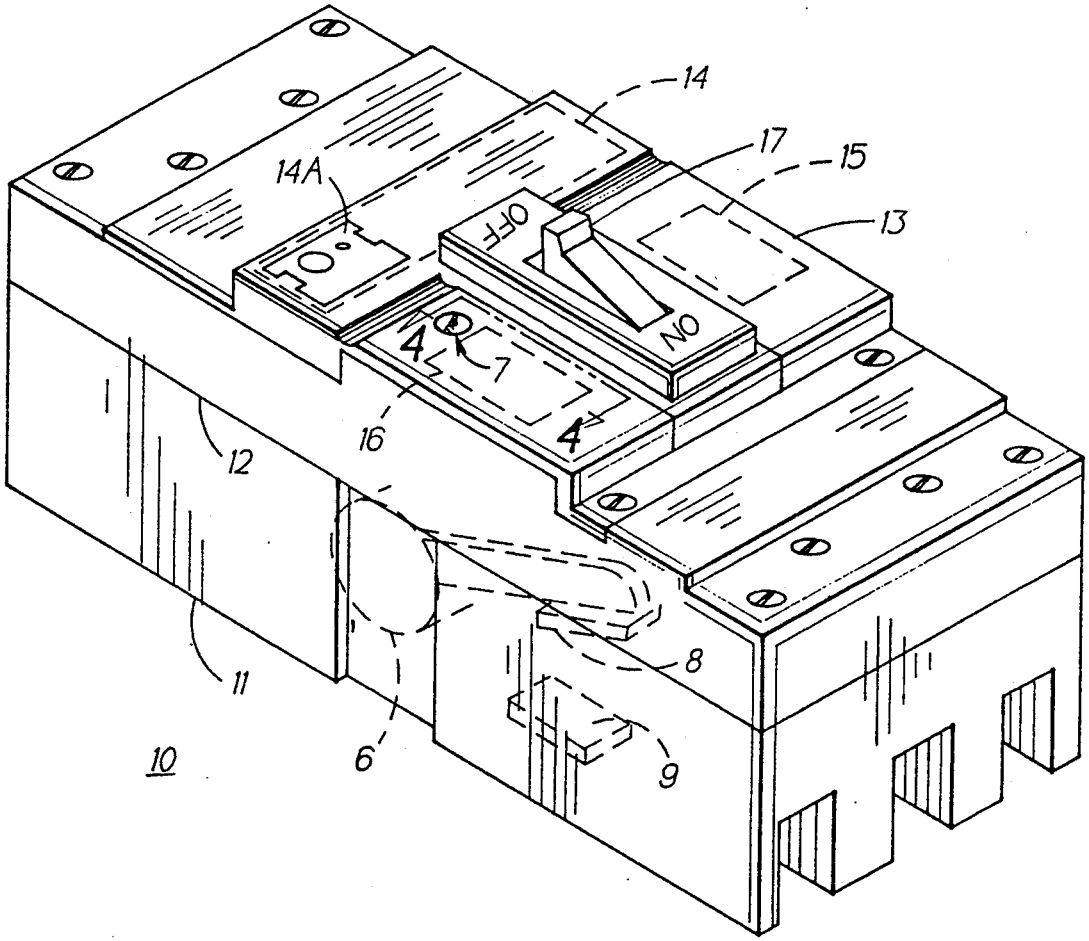
FIG. 1 is a top perspective view of a circuit breaker employing the trip-to-test button in accordance with the invention.

An electronic trip circuit breaker 10 hereafter "circuit breaker", is depicted in FIG. 1 and consists of a molded plastic case 11 to which a molded plastic cover 12 is fixedly secured. An accessory cover 13 is attached to the circuit interrupter cover and provides access to an electronic trip unit 14, an actuator-accessory unit 15 and an optional accessory unit such as the auxiliary switch unit depicted at 16. An operating handle 17 extends through the circuit interrupter cover and provides manual intervention to turn the circuit interrupter contacts 8, 9 between their open and closed positions. A rating plug 14A electrically communicates with the electronic trip unit to set the ampere rating of the circuit breaker. A trip-to-test button 7 is installed within the circuit breaker cover to manually articulate the circuit breaker operating mechanism (not shown) and to separate the circuit breaker contacts by rotation of the operating mechanism crossbar 6.

Figure 2:
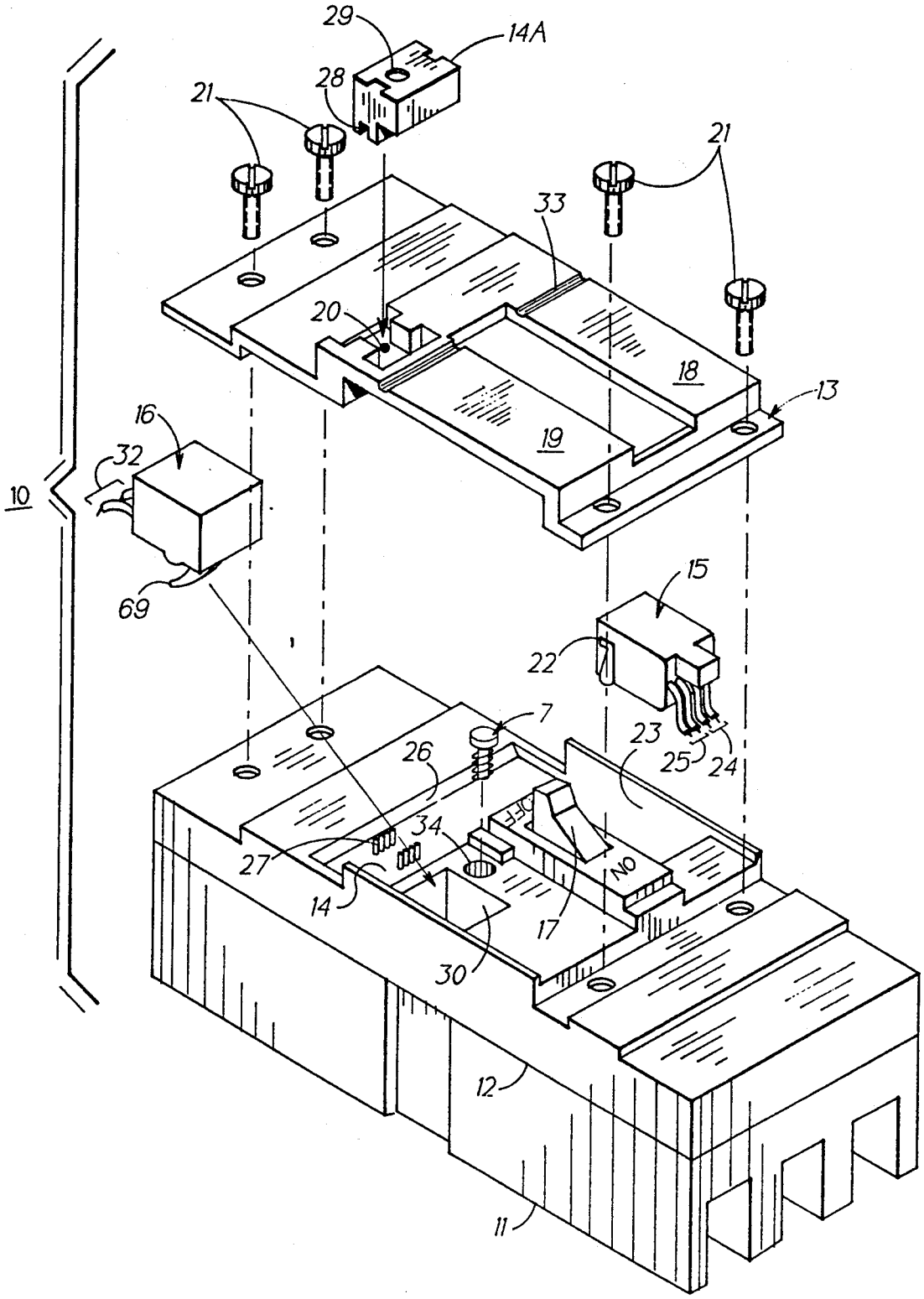
FIG. 2 is a top perspective view of the circuit breaker of FIG. 1 prior to assembly of the accessory cover and accessory components.

A pair of accessory doors 18, 19 are formed in the accessory cover for providing access to the actuator-accessory unit 15 and auxiliary switch 16, shown in the circuit breaker 10 depicted in Figure 2. The rating plug 14A is fitted within a recess 20 formed in the accessory cover and the accessory cover is fastened to the circuit breaker cover by means of screws 21. Still referring to FIG. 2, the actuator-accessory unit 15 contains a flux shifting coil (not shown) and is fitted with an actuator lever 22 for articulating the circuit breaker operating mechanism. The actuator-accessory unit 15 is fitted within a recess 23 and connects with the electronic trip unit 14 by means of wire conductors 24 and with an external shunt trip switch by means of wire conductors 25. The electronic trip unit 14 is inserted in the electronic trip unit recess 26 formed in the circuit breaker cover 12 and connects electrically with the rating plug 14A by means of connector pins 27 upstanding on the electronic trip unit and sockets 28 formed in the bottom of the rating plug. The rating plug is described in U.S. Pat. No. 4,728,914. Access opening 29 formed on the top of the rating plug allows for verifying the trip characteristics of the electronic trip unit. The electronic trip unit electrically connects with a current transformer (not shown) contained within the circuit breaker case 11 and which is described in U.S. Pat. No. 4,591,942. The circuit breaker includes three poles, with one current transformer supplied within each separate pole. The auxiliary switch unit 16 is inserted within the recess 30 formed in the circuit breaker cover and is positioned such that a depending lever 69 interacts with the circuit breaker operating mechanism. A pair of wire conductors 32 electrically connect to a remote bell or alarm to indicate the closed or open condition of the circuit breaker contacts. In the particular arrangement depicted in FIG. 2, access to the actuator-accessory unit 15 is made by means of accessory door 18 which is integrally-formed within the accessory cover 13 and access to the auxiliary switch 16 made by means of the corresponding accessory door 19. The accessory doors 18, 19 are hingeably attached to the accessory cover 13 by means of a hinge 33 integrally-formed therein. A good description of the accessory cover 13 is found within U.S. Pat. No. 4,754,247. In further accordance with the invention, the trip-to-test button 7 hereafter "test button" is inserted within the test button recess 34 formed within the circuit breaker cover 12 next to the operating handle 17.

Figure 3:
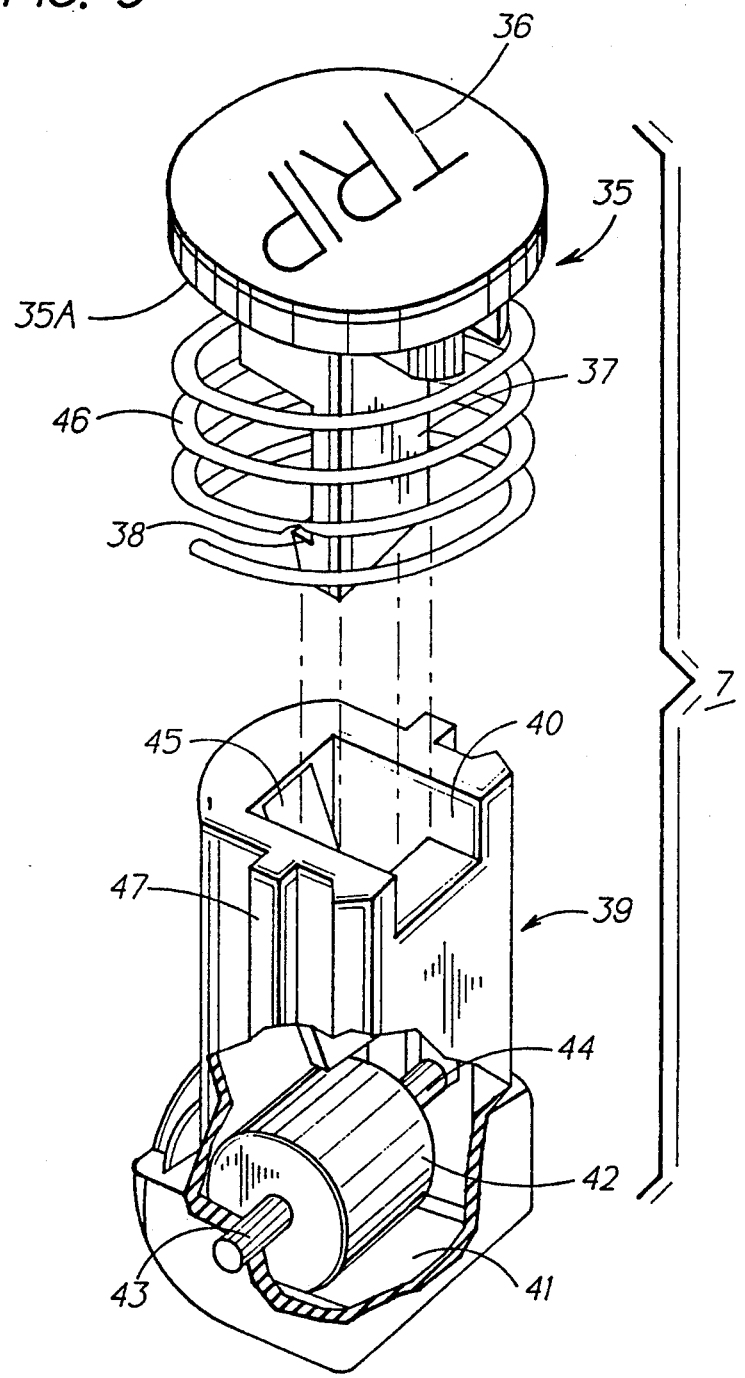
FIG. 3 is an enlarged top perspective isometric view of the trip-to-test button according to the invention.

As shown in FIG. 3, the test button 7 is formed from a thermoplastic composition into a top piece 35 having integrally-formed indicia 36 and a bottom piece 39 having externally extending ribs 47 which are received within the test button recess in press-fit relation. The top piece includes an integrally-formed bottom extension 37 having a hook-shaped end 38. The bottom piece 39 defines a top opening 40 and a bottom opening 41. The top opening receives the bottom extension which becomes attached by capturing the hook-shaped end 38 behind the end of the cantilevered extension 45 formed within the bottom piece 39. A roller 42 is arranged at the bottom opening 41 of the bottom piece 39 and is arranged for rotation about a pivot pin 43 which extends through the roller and is supported by a pair of openings 44 formed within the bottom piece adjacent the bottom opening to prevent debris generated within the circuit breaker case during circuit interruption from reaching the interior of the bottom piece. This is an important feature since prior test buttons were exposed to the debris generated within the circuit breaker case during intense circuit interruption conditions. The compression spring 46 is arranged about the combined top and bottom pieces and becomes trapped between the bottom surface 35A of the top piece 35 and bottom surface 34A of the trip button recess 34 within the circuit breaker cover 12 when the trip button 7 is inserted within the circuit breaker cover as best seen by referring now to FIGS. 4A,4B.

Figure 4A:
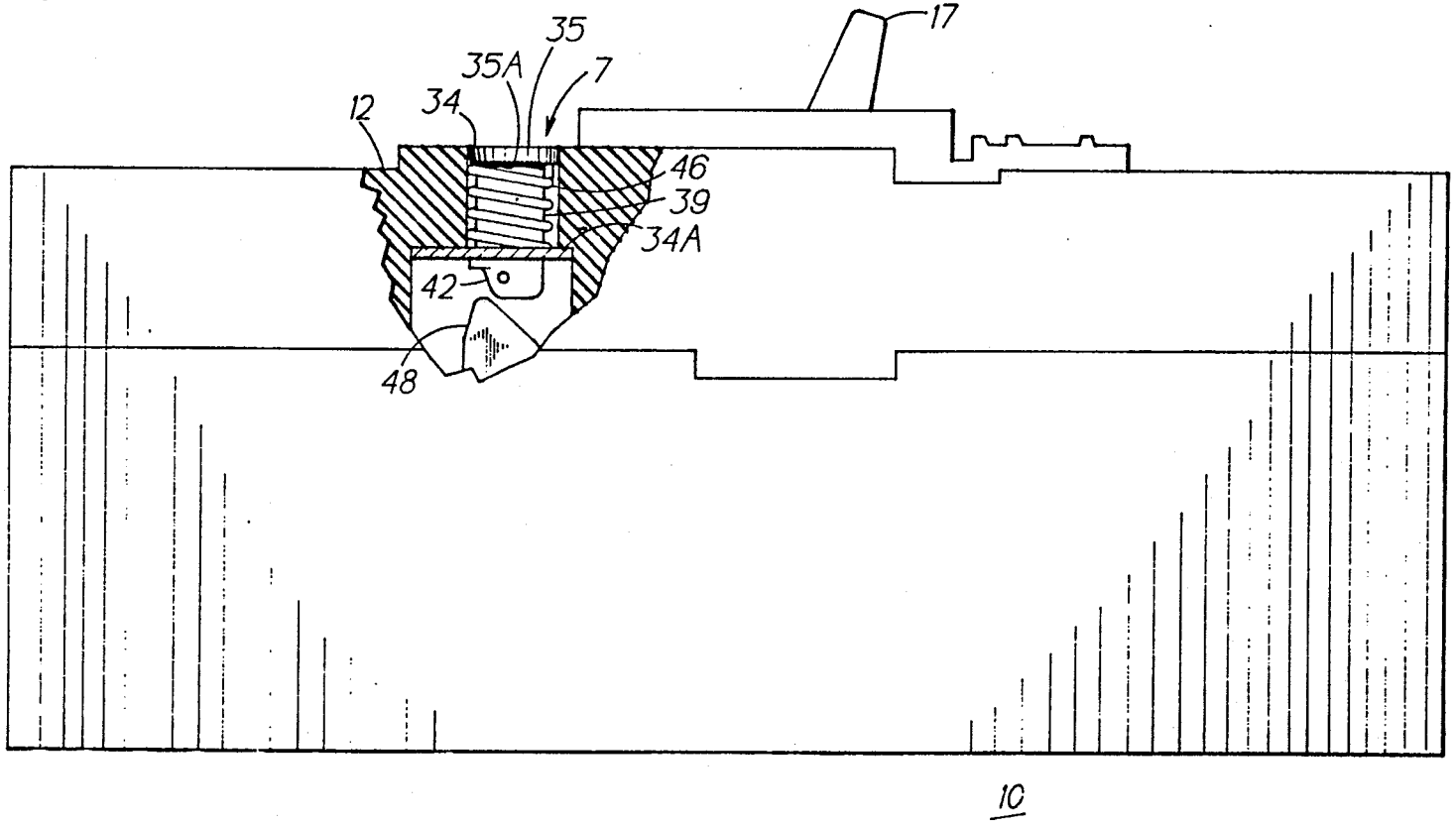
FIG. 4A is an enlarged cutaway side view of the circuit breaker of FIG. 1 depicting the trip-to-test button in a non-operative state.
Figure 4B:
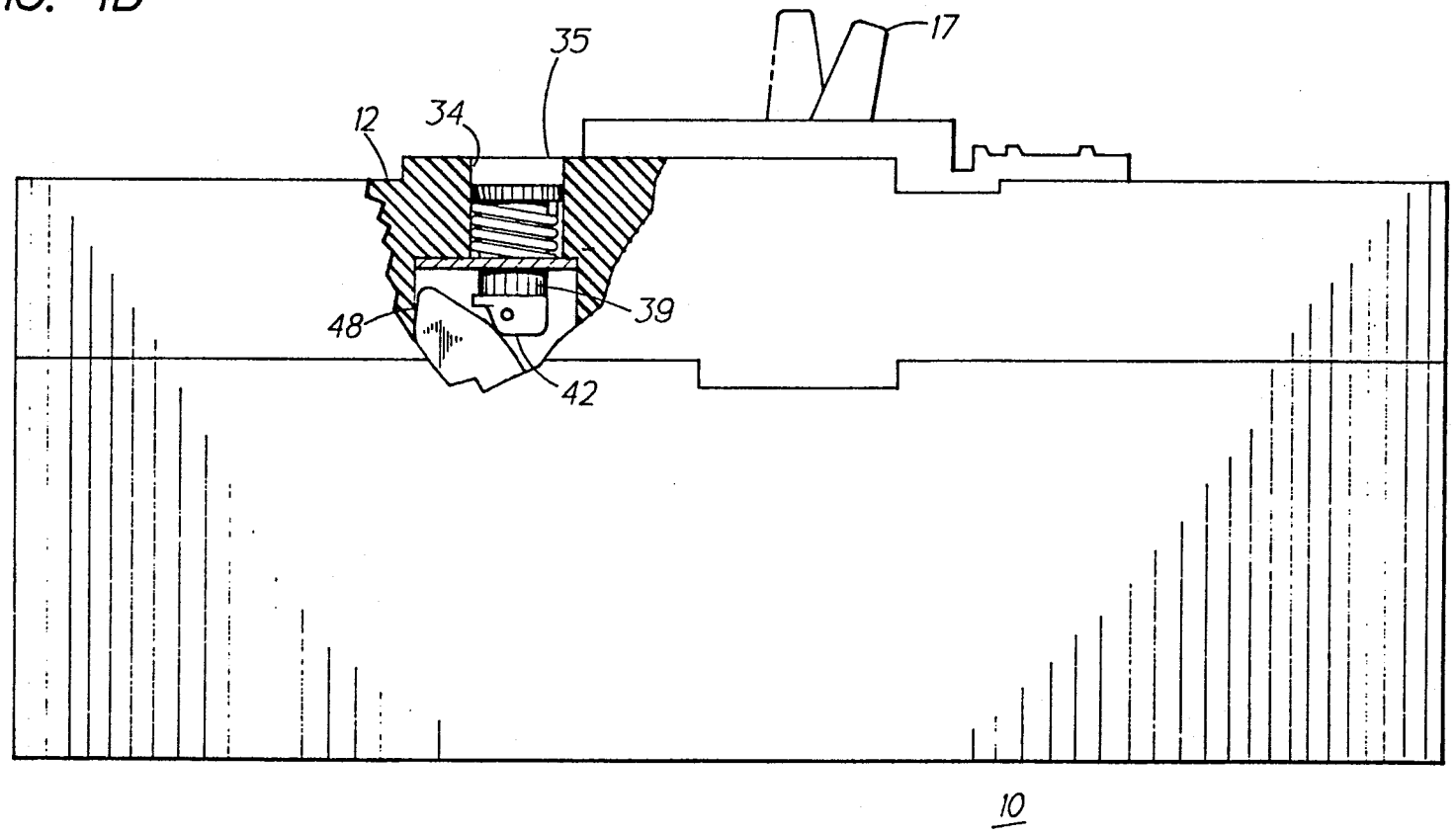
FIG. 4B is an enlarged cutaway side view of the circuit breaker of FIG. 1 depicting the trip-to-test button in an operative state.

The operation of the trip button 7 within the circuit breaker 10 of FIG. 4A is depicted with the circuit breaker operating handle 17 in the ON position. The circuit breaker contacts 8,9 (FIG. 1) are in their closed conditions and the roller 42 is out of contact with the circuit breaker operating mechanism trip bar 48. A good description of the operation of the trip bar to articulate the operating mechanism is found in U.S. Pat. No. 5,027,092. In the normal operating position, the top piece 35 is flush with the circuit breaker cover 12 and the compression spring 46 disposed about the bottom piece 39 is not flexed against the bottom surface 34A. When the top piece 35 is depressed below the surface of the circuit breaker cover 12, as shown in FIG. 4B, the bottom piece 39 is displaced downwards within the trip button recess 34 moving the associated roller 42 into contact with the trip bar 48 and thereby articulating the circuit breaker operating mechanism separating the circuit breaker contacts. The circuit breaker operating handle 17 immediately moves to the TRIPPED position indicated in phantom to show that the trip function is operational. The compression spring immediately returns the top and bottom pieces 35, 39 upwards within the trip button recess 34 to the original position shown in FIG. 4A when the top piece 35 is no longer depressed.

Having thus described the invention, what we claim as new and desire to secure by Letters Patent is:

We claim:

1. A circuit breaker comprising:

a plastic circuit breaker case and a plastic circuit breaker cover;

a pair of contacts within said circuit breaker case arranged for automatic separation by means of an operating mechanism;

an operating handle extending through said circuit breaker cover for manually turning said contacts between open and closed conditions;

a trip unit within said circuit breaker cover determining overcurrent conditions through a protected circuit and activating said operating mechanism to separate said contacts and interrupt circuit current; and a trip button arranged within said circuit breaker cover and extending within said circuit breaker case, said trip button including a top piece formed of an electrically-insulative material and having one end externally accessible from said circuit breaker cover and an opposite end extending within said circuit breaker cover, said trip bottom also including a bottom piece open at a top end and at a bottom end thereof, said top end receiving said opposite end of said of said top piece and said bottom end supporting a roller member to contact a trip bar associated with said operating mechanism and thereby articulate said operating mechanism for test purposes.

2. The circuit breaker of claim 1 wherein said bottom piece is fits within an opening formed within said circuit breaker cover.

3. The circuit breaker of claim 2 wherein said trip button further includes a compression spring arranged around said top and said bottom piece, said compression spring being capture a bottom of said top piece and said opening.

4. The circuit breaker of claim 1 wherein said roller member partially closes said bottom end.

5. The circuit breaker of claim 3 wherein said top and bottom piece move in unison when said top piece is depressed against said compression spring.

6. The circuit breaker of claim 1 wherein said bottom piece includes a ramp part integrally-formed therein.

7. The circuit breaker of claim 6 wherein said top piece includes a hook-shaped piece on said opposite end, whereby said hook-shaped piece becomes captured by said ramp part when said top piece is inserted within said bottom piece.

8. The circuit breaker of claim 1 wherein said bottom end of said bottom piece includes a pair of opposing openings formed therein.

9. The circuit breaker of claim 8 including a pivot pin extending through said roller means and said opposing slots.

* * * * *